US009062512B2

(12) United States Patent
Hart

(10) Patent No.: US 9,062,512 B2
(45) Date of Patent: Jun. 23, 2015

(54) INTEGRATED INSTALLATION WORKOVER CONTROL SYSTEM

(75) Inventor: Brian Hart, Wakefield (GB)

(73) Assignee: OneSubsea IP UK Limited, London (GB)

( * ) Notice: Subject to any disclaimer, the term of this patent is extended or adjusted under 35 U.S.C. 154(b) by 173 days.

(21) Appl. No.: 13/063,971

(22) PCT Filed: Oct. 9, 2009

(86) PCT No.: PCT/US2009/060247

§ 371 (c)(1),
(2), (4) Date: Mar. 15, 2011

(87) PCT Pub. No.: WO2010/042873

PCT Pub. Date: Apr. 15, 2010

(65) Prior Publication Data

US 2011/0297387 A1 Dec. 8, 2011

Related U.S. Application Data

(60) Provisional application No. 61/104,341, filed on Oct. 10, 2008.

(51) Int. Cl.
*E21B 43/01* (2006.01)
*E21B 33/035* (2006.01)

(52) U.S. Cl.
CPC ..... *E21B 33/0355* (2013.01)

(58) Field of Classification Search
CPC ..... E21B 33/0355
USPC ..... 166/336, 338, 339, 344, 345, 350, 351, 166/358, 359, 367, 368
See application file for complete search history.

(56) References Cited

U.S. PATENT DOCUMENTS

| | | | | |
|---|---|---|---|---|
| 2,990,851 | A * | 7/1961 | Jackson, Jr. et al. | 137/595 |
| 3,426,843 | A * | 2/1969 | Visser | 166/352 |
| 3,640,299 | A * | 2/1972 | Nelson | 137/1 |
| 4,046,192 | A * | 9/1977 | Darnborough et al. | 166/337 |
| 4,332,509 | A * | 6/1982 | Reynard et al. | 405/168.1 |
| 4,730,677 | A | 3/1988 | Pearce et al. | |
| 6,082,460 | A * | 7/2000 | June | 166/348 |
| 6,102,124 | A | 8/2000 | Skeels et al. | |
| 6,296,066 | B1 * | 10/2001 | Terry et al. | 175/92 |
| 6,484,806 | B2 | 11/2002 | Childers et al. | |
| 7,318,480 | B2 * | 1/2008 | Hosie et al. | 166/367 |

(Continued)

OTHER PUBLICATIONS

PCT/US2009/060247 International Search Report and Written Opinion, Apr. 30, 2010 (10 p.).

*Primary Examiner* — James G Sayre
(74) *Attorney, Agent, or Firm* — Chamberlain Hrdlicka

(57) ABSTRACT

A subsea production system for controlling fluid flow from a well. The system includes a subsea production tree and a drilling riser engageable with the well. The tree includes electrical and hydraulic lines to communicate with equipment in the tree and downhole in the well. The system also includes a tieback tool that can be installed in the tree through the drilling riser to establish communication with the tree electrical and hydraulic lines and permit access into the well bore. The system also includes an umbilical connectable with the tieback tool and extendable inside the drilling riser to the surface. The umbilical can be used to communicate the tieback tool. The umbilical can also be used to communicate with the tree and downhole equipment through the tieback tool connection with the tree.

19 Claims, 2 Drawing Sheets

(56) References Cited

U.S. PATENT DOCUMENTS

| | | | | |
|---|---|---|---|---|
| 7,416,025 | B2 | 8/2008 | Bhat et al. | |
| 7,798,234 | B2 * | 9/2010 | Ju et al. | 166/367 |
| 2004/0074635 | A1 * | 4/2004 | Collie et al. | 166/85.1 |
| 2004/0262008 | A1 * | 12/2004 | Deans et al. | 166/339 |
| 2005/0217845 | A1 * | 10/2005 | McGuire | 166/100 |
| 2008/0202761 | A1 * | 8/2008 | Trewhella | 166/351 |
| 2009/0038804 | A1 * | 2/2009 | Going, III | 166/335 |
| 2009/0194290 | A1 * | 8/2009 | Parks et al. | 166/339 |
| 2009/0229830 | A1 * | 9/2009 | Kerr | 166/336 |

* cited by examiner

INTEGRATED INSTALLATION WORKOVER CONTROL SYSTEM

CROSS-REFERENCE TO RELATED APPLICATIONS

This application is a 35 U.S.C. § 371 national stage application of PCT/US2009/060247 filed Oct. 9, 2009, which claims the benefit of U.S. Provisional Patent Application No. 61/104,341 filed Oct. 10, 2008, both of which are incorporated herein by reference in their entireties for all purposes.

STATEMENT REGARDING FEDERALLY SPONSORED RESEARCH OR DEVELOPMENT

Not Applicable.

BACKGROUND

Installation and Workover Control Systems (IWOCS) are used to provide hydraulic pressure and enable pressure and temperature monitoring during the installation and intervention of tubing hangers and subsea trees to enable production from subsea wells. They can also be used for injection (typically, using water) into wells to enhance or maintain production from other wells in the same field. Intervention tasks can include activities such as production flow testing, downhole well logging, and wirelining activities.

The tubing hanger, which suspends the production tubing (known as the downhole completion), may be installed in a subsea wellhead, a tubing head spool, or directly into a subsea tree. The mechanical tooling used in conjunction with the tubing hanger typically includes: a Tubing Hanger Running Tool (THRT), a Subsea Test Tree (SSTT), and a completion riser system. The THRT is hydraulically latched to the tubing hanger during installation or intervention. The SSTT, a self-contained valving arrangement, is affixed above the THRT (these two items are often kept assembled together). The completion riser system is attached above the SSTT and includes a series of tubular sections (known as "joints") to provide a pressure containing conduit between the tubing hanger and the surface drilling rig. For safety reasons, during installation or intervention of a downhole completion it is necessary to employ a subsea Blow Out Preventer (BOP) stack with a drilling riser system connected back to the surface drilling rig. The BOP stack and drilling riser system for subsea applications includes an internal bore to enable passage of the tubing hanger, the THRT, the SSTT, and the completion riser (the bore of the BOP stack and the drilling riser system is usually 18 ¾" minimum diameter). The drilling riser itself also includes a series of "joints" which are made up at surface, as required, to suit the specific water depth.

There are several variations of subsea trees currently being installed in field developments, one of which is a vertical tree whereby the drilling BOP stack is directly installed onto the tree re-entry mandrel. The trees may be installed directly onto an underwater wellhead or tubing head spool arrangement.

The system whereby the downhole completion has been installed through a BOP stack and the BOP stack installed on the tree has traditionally necessitated the use of two IWOCS umbilical systems and associated reels, connection, and attachment features. The first umbilical is installed inside the drilling riser and BOP stack and provides hydraulic control of the SSTT, the THRT, the tubing hanger, and downhole valves. This umbilical could be temporarily affixed to the completion riser during operations. An additional, umbilical external to the drilling riser would be incorporated for subsequent operation of the appropriate subsea tree valves and downhole valves for pressure testing, chemical injection, and monitoring. The external umbilical would typically be affixed to the drilling riser and would require an Emergency Disconnect Unit (EDU) retro-fitted to the BOP stack to permit the stack's Lower Marine Riser Package (LMRP) to be disconnected in the event of adverse weather conditions. The umbilical configuration typically includes direct hydraulic lines for shallow water applications and multiplex electro-hydraulic lines for deeper water applications.

Following satisfactory installation of the subsea tree onto the previously installed downhole completion (in the wellhead or tubing head spool) and flow testing of the well (if required), the internal tooling is retrieved. This includes the THRT, the SSTT, the completion riser system, and the internal umbilical. The external equipment, including the BOP stack, the drilling riser system, and the external umbilical would then be recovered back to the surface rig. Production of the formation fluids may then commence under planned operations. During the life of the well, various intervention and workover procedures may be necessary to ensure continued production. These procedures usually include the installation and subsequent retrieval of all the aforementioned equipment similarly to the procedures just discussed.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
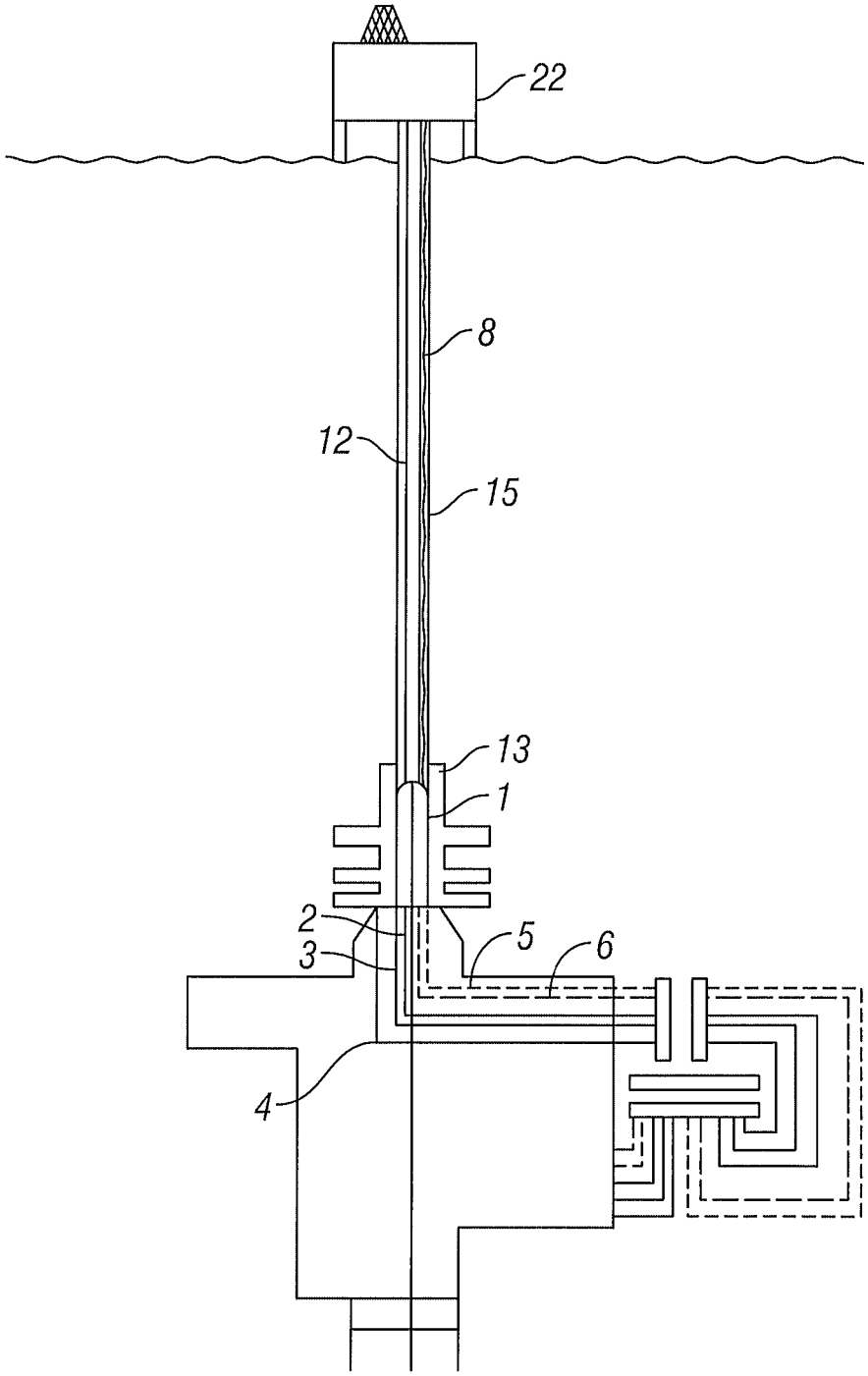
FIG. 1 is a composite view of a subsea system that illustrates an Integrated Installation and Workover Control System (IIWOCS) embodiment.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present invention is subject to embodiments of different. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
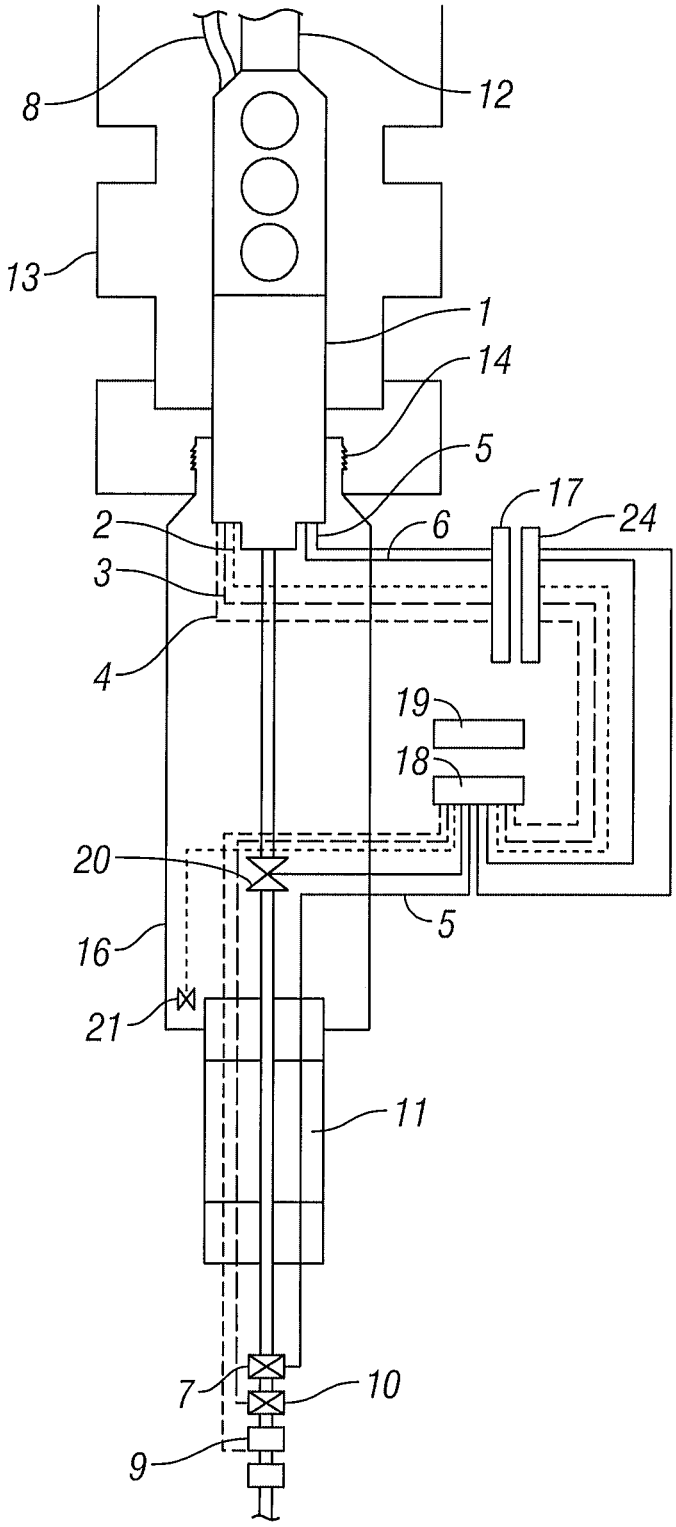
FIG. 2 is a schematic of the interface between the Integrated Installation and Workover Control System (IIWOCS) and a subsea production control system.

Referring to FIGS. 1 and 2, there is shown an example configuration of an Integrated Installation and Workover Control System (IIWOCS). It should be appreciated that, although the description below includes a vertical tree 16, the IIWOCS may be suitably configured for installation in both vertical or horizontal trees. As shown, instead of an existing control umbilical extending outside of the drilling riser system 15, intervention and production tree flow testing control capabilities are integrated with a IIWOCS umbilical 8 extending internally within the drilling riser system 15. Integrating the two control systems includes use of a tieback tool 1 installed inside the drilling riser 15 via a surface rig or vessel 22 with appropriate electrical and hydraulic supply equipment and associated controls. As an example, the tieback tool 1 may include the THRT and, as shown, possibly the SSTT. The tieback tool 1 is lowered from the surface on the completion riser system 12 in conjunction with a multiplex electro-hydraulic umbilical 8, through the BOP stack 13 and the drilling riser 15 such that the control lines (contained within the umbilical 8) extend from the tieback tool 1 to the surface inside the drilling riser 15. After the tieback tool 1 passes through the BOP stack 13, it is latched within the tree re-entry mandrel 14. A hydraulic high pressure supply line 5, a hydraulic low pressure supply line 6, and electrical power line 2, an electrical communication line 3, and an electrical pressure/temperature monitoring line 4 route from the base of the tieback tool 1 to outside the vertical subsea tree 16. These lines extend from the tree 16 and terminate in a junction plate 17 which is made up, with the aid of an ROV, to a fixed junction plate 24 on the tree 16. From the fixed junction plate 24, all the aforementioned lines are routed to the Subsea Control Module Mounting Base (SCMMB) 18 and, in turn, the Subsea Control Module (SCM) 19. In this embodiment, the hydraulic low pressure supply 6 is directed to the subsea tree mounted production master valve 20 and the annulus master valve 21. In this embodiment, the hydraulic low pressure supply 6 is also directed from the SCM, via the subsea tree 16 and the tubing hanger 11, to the production isolation valve 7, located in the production string. The hydraulic high pressure supply 5 is directed, via the subsea tree 16 and the tubing hanger 11, to the Surface Controlled Subsea Safety Valve (SCSSV) 10 located in the production tubing string. The electrical pressure/temperature sensor monitoring line 4 is routed from the SCM 19, via the SCMMB 18, the subsea tree 16, and the tubing hanger 11 to the downhole pressure/temperature sensor 9.

Thus, operation of necessary production tree and completion control valves and pressure/temperature monitoring can be undertaken during installation and well intervention without the use of an external control umbilical, thus saving considerable rig time and equipment expense in bringing the well online for production. After the intervention tasks have been completed the tieback tool 1, the completion riser 12, and the control umbilical 8 are retrieved followed by recovery of the BOP stack 13 and the drilling riser 15. The well may then be brought "on stream" using established production procedures.

Subsequent intervention or workover can be undertaken during the life of the well as outlined previously.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A subsea production system for controlling fluid flow from a well, the system including:

a subsea production tree and a drilling riser engageable with the well, the tree including electrical and hydraulic lines to communicate with equipment in the tree and downhole in the well;

a tieback tool that can be installed in the tree through the drilling riser to establish at least one of electrical and hydraulic communication with the tree electrical and hydraulic lines;

an umbilical connectable with the tieback tool and extendable inside the drilling riser to the surface;

where the umbilical can be used to communicate at least one of electrically and hydraulically with the tieback tool;

where the umbilical can be used to communicate at least one of electrically and hydraulically with the tree and downhole equipment through the tieback tool connection with the tree; and where the umbilical can at least one of control and monitor the tieback tool and the tree equipment.

2. The subsea production system of claim 1, where the tieback tool includes at least one of a tubing hanger running tool and a subsea test tree.

3. The subsea production system of claim 1, where the umbilical can at least one of control and monitor the downhole equipment.

4. The subsea production system of claim 1, where the umbilical can be used to perform at least one of pressure testing, hanger installation, production flow testing, downhole well logging, chemical injection, wireline activities, and well monitoring.

5. The subsea production system of claim 1, where the umbilical is a multi-plex electro-hydraulic umbilical.

6. The subsea production system of claim 1, where the tieback tool is installed using a completion riser system.

7. The subsea production system of claim 1, the tree equipment includes fluid control valves and the downhole equipment includes at least one of pressure and temperature sensors.

8. A subsea production system for controlling fluid flow from a well, the system including:

a subsea production tree and a drilling riser engageable with the well, the tree including electrical and hydraulic lines to communicate with equipment in the tree and downhole in the well;

a tieback tool, including a tubing hanger running tool and a subsea test tree, that can be installed in the tree through the drilling riser to establish communication with the tree electrical and hydraulic lines;

an umbilical connectable with the tieback tool and extendable inside the drilling riser to the surface;

where the umbilical can be used to control the tieback tool; and where the umbilical can also be used to control tree valves and monitor at least one of downhole pressure and temperature sensors through the tieback tool connection with the tree.

9. The subsea production system of claim 8, where the umbilical can at least one of control and monitor the tieback tool, the tree equipment, and the downhole equipment.

10. The subsea production system of claim 8, where the umbilical can be used to perform at least one of pressure testing, hanger installation, production flow testing, downhole well logging, chemical injection, wireline activities, and well monitoring.

11. The subsea production system of claim 8, where the umbilical is a multi-plex electro-hydraulic umbilical.

12. The subsea production system of claim 8, where the tieback tool is installed using a completion riser system.

13. A method of controlling fluid flow from a subsea well including:

installing a subsea production tree and a drilling riser to the well, the tree including electrical and hydraulic lines for controlling equipment on the tree and communicating with downhole equipment in the well;

installing a tieback tool to the tree through the drilling riser, the tieback tool establishing at least one of electrical and hydraulic communication between the tree electrical and hydraulic lines and an umbilical extending inside the drilling riser;

communicating at least one of electrically and hydraulically with the tieback tool and the tree and downhole equipment using the umbilical to control fluid flow from the well; and using the umbilical to control and monitor at least one of the tieback tool and the tree equipment.

14. The method of claim 13, where the tieback tool includes at least one of a tubing hanger running tool and a subsea test tree.

15. The method of claim 13 further including using the umbilical to control and monitor the downhole equipment.

16. The method of claim 13, where controlling fluid flow from the well includes at least one of pressure testing, hanger installation, production flow testing, downhole well logging, chemical injection, wireline activities, and well monitoring.

17. The method of claim 13, where the umbilical is a multi-plex electro-hydraulic umbilical.

18. The method of claim 13, further including installing the tieback tool using a completion riser system.

19. The method of claim 13, where the tree equipment includes fluid control valves and the downhole equipment includes at least one of fluid control valves and pressure and temperature sensors.

* * * * *